US006176039B1

(12) United States Patent
Craig

(10) Patent No.: US 6,176,039 B1
(45) Date of Patent: Jan. 23, 2001

(54) GARAGE DOOR MOUNTED OBJECT SENSOR SYSTEM

(76) Inventor: Terry A. Craig, 6550 Manila Rd., Goshen, OH (US) 45122

( * ) Notice: Under 35 U.S.C. 154(b), the term of this patent shall be extended for 0 days.

(21) Appl. No.: 09/444,446

(22) Filed: Nov. 22, 1999

(51) Int. Cl.[7] ..... E05F 15/02
(52) U.S. Cl. ..... 49/26; 49/197
(58) Field of Search ..... 49/26, 27, 28, 49/197, 199, 200; 248/542, 550, 284.1, 240; 318/480

(56) References Cited

U.S. PATENT DOCUMENTS

| | | | | |
|---|---|---|---|---|
| 2,909,718 | | 10/1959 | Lawick . | |
| 2,929,623 | | 3/1960 | Marmont et al. . | |
| 4,560,912 | | 12/1985 | Jonsson . | |
| 4,621,452 | | 11/1986 | Deeg . | |
| 4,984,658 | | 1/1990 | Peelle, Jr. et al. . | |
| 5,428,923 | * | 7/1995 | Waggamon | 49/25 |
| 5,508,511 | * | 4/1996 | Zur et al. | 49/26 |
| 5,625,980 | | 5/1997 | Teich et al. . | |
| 5,656,900 | | 8/1997 | Michel et al. . | |
| 5,839,227 | * | 11/1998 | Gardner | 49/27 |
| 5,934,019 | * | 8/1999 | Rotharmel et al. | 49/25 |
| 5,937,578 | * | 8/1999 | Dolan et al. | 49/26 |
| 5,964,058 | * | 10/1999 | Richardson | 49/27 |
| 6,020,703 | * | 2/2000 | Telmet | 318/480 |
| 6,051,947 | * | 4/2000 | Lhotak et al. | 318/445 |

FOREIGN PATENT DOCUMENTS

| | | | | |
|---|---|---|---|---|
| 1129144/29-14 | * | 1/1967 | (SU) | 49/27 |
| 759240 | * | 1/1967 | (GB) | 49/27 |

* cited by examiner

*Primary Examiner*—Daniel P. Stodola
*Assistant Examiner*—Curtis A. Cohen
(74) *Attorney, Agent, or Firm*—Charles R. Wilson

(57) ABSTRACT

An object sensor system is mounted on a garage door controlled by an electric garage door opener. The sensor system senses objects directly in the travel path of the door's leading edge. Each object sensor of the system comprises a mounting plate for permanent attachment to the garage door near a leading edge of the door, an upper hinge plate hingeably connected to the mounting plate, a lower hinge plate hingeably connected to the mounting plate and a connecting hinge plate connected to the upper and lower hinge plates. The plates are connected to move in concert. Each of the object sensors also includes a bracket having a first leg attached to the connecting hinge plate and a second leg extending horizontally towards the mounting plate and under the leading edge of the door. An electronic sensor is mounted on the bracket's second leg at a distal end to transmit or receive a light beam. An anti-friction slide pad is attached to an underside of the second leg of the bracket to allow the bracket with its sensor to move inwardly as the door's leading edge approaches ground surface. As the door travels downwardly, each electronic sensor moves with the door until the bracket hits ground surface, at which time, the upper and lower hinge plates are forced to pivot upwardly thereby forcing the bracket with its electronic sensor to move backwardly away from the garage door.

20 Claims, 5 Drawing Sheets

GARAGE DOOR MOUNTED OBJECT SENSOR SYSTEM

FIELD OF THE INVENTION

This invention relates to a garage door object sensor system. More particularly, the invention relates to an object sensor system mounted on the garage door to sense objects directly in the door's leading edge travel path.

BACKGROUND OF THE INVENTION

Electric garage door openers have become very commonplace. A reversible motor is normally mounted on a garage ceiling. The garage door, mounted to move along tracks from a fully open position to a fully closed position, is connected to the reversible motor. A remote controller which is usually kept in the auto is used to open and close the door. A door switch is also normally mounted inside the garage near the garage door frame and hard-wired to the reversible motor. As well known, the common electric door opener is a real convenience to the car owner. It also eliminates back strain oftentimes experienced by having to manually open a garage door.

In recent years, electric garage door opener systems have been required to include safety devices to prevent the door from accidently closing on an individual or object. For example, an infrared transmitter unit and a receiver unit are mounted on the garage door's frame usually near ground surface and usually inside the garage. The transmitter emits a light beam directly across to the receiver. As long as the light beam is uninterrupted, it is presumed no object is in the travel path of the garage door. If the light beam is interrupted by the presence of an object, a signal is sent to the reversible motor to stop further movement of the garage door. The transmitter and receiver are laterally offset a few inches from the garage door. Also, they sense only objects which extend fully or almost fully to the ground surface. In most cases, this is adequate. However, it is possible with this type of detecting system for an object to be located such that it will not be detected by the sensors, yet still be in the travel path of the garage door. For example, an auto may be only partially pulled into the garage such that its wheels are not in the light beam of the infrared ray transmission, yet its trunk lid extends outwardly and is in the garage door's travel path. A closing garage door will hit the trunk lid with sufficient force that noticeable damage occurs.

The ultimate object sensor for an electric garage door opener would sense objects directly in the path of the garage door's leading edge to eliminate "blind spots" associated with present garage door opener systems. The object sensor would also respond promptly to the presence of an object and stop further garage door movement. In accord with this need, there has now been developed a garage door mountable object sensor system which moves with the door to sense objects directly in the path of the door's leading edge. The sensor system is readily mounted on the garage door and either hard-wired to the opener's reversible motor or is battery operated. Most importantly, the object sensor is mounted in a manner which allows the garage door to open and close as normal.

SUMMARY OF THE INVENTION

An object sensor system is for use with an electric garage door opener. The system includes two object sensors mounted on the garage door. Together, they are able to sense objects directly in the door's travel path. Each object sensor comprises a mounting plate for permanent attachment to the garage door near a leading edge of the door, an upper hinge plate hingeably connected to the mounting plate, a lower hinge plate hingeably connected to the mounting plate and a connecting hinge plate connected to the upper and lower hinge plates. The plates are connected to move in concert. The object sensor also includes a bracket having a first leg attached to the connecting hinge plate and a second leg extending horizontally under the leading edge of the door. An electronic sensor is mounted on the second leg of the bracket to transmit or receive a light beam. An anti-friction means is attached to an underside of the second leg of the bracket to allow the bracket with its sensor to freely move inwardly as the door's leading edge approaches ground surface. The electronic sensors are mounted on the brackets so as to be directly underneath the door's leading edge when the door is at least partially open. As the door travels downwardly, each electronic sensor moves with the door until the anti-friction means on the bracket hits ground surface, at which time, the upper and lower hinge plates are forced to pivot upwardly thereby forcing the bracket with its electronic sensor to move backwardly away from the garage door.

DETAILED DESCRIPTION OF THE INVENTION

The object sensor system of the invention is particularly useful on residential overhead garage doors equipped with electric motor door openers and is described in detail for this primary use. However, the object sensor system is also useful on commercial and industrial doors of various designs. The components of the system and their interactions are described in detail in the following paragraphs.

Figure 1:
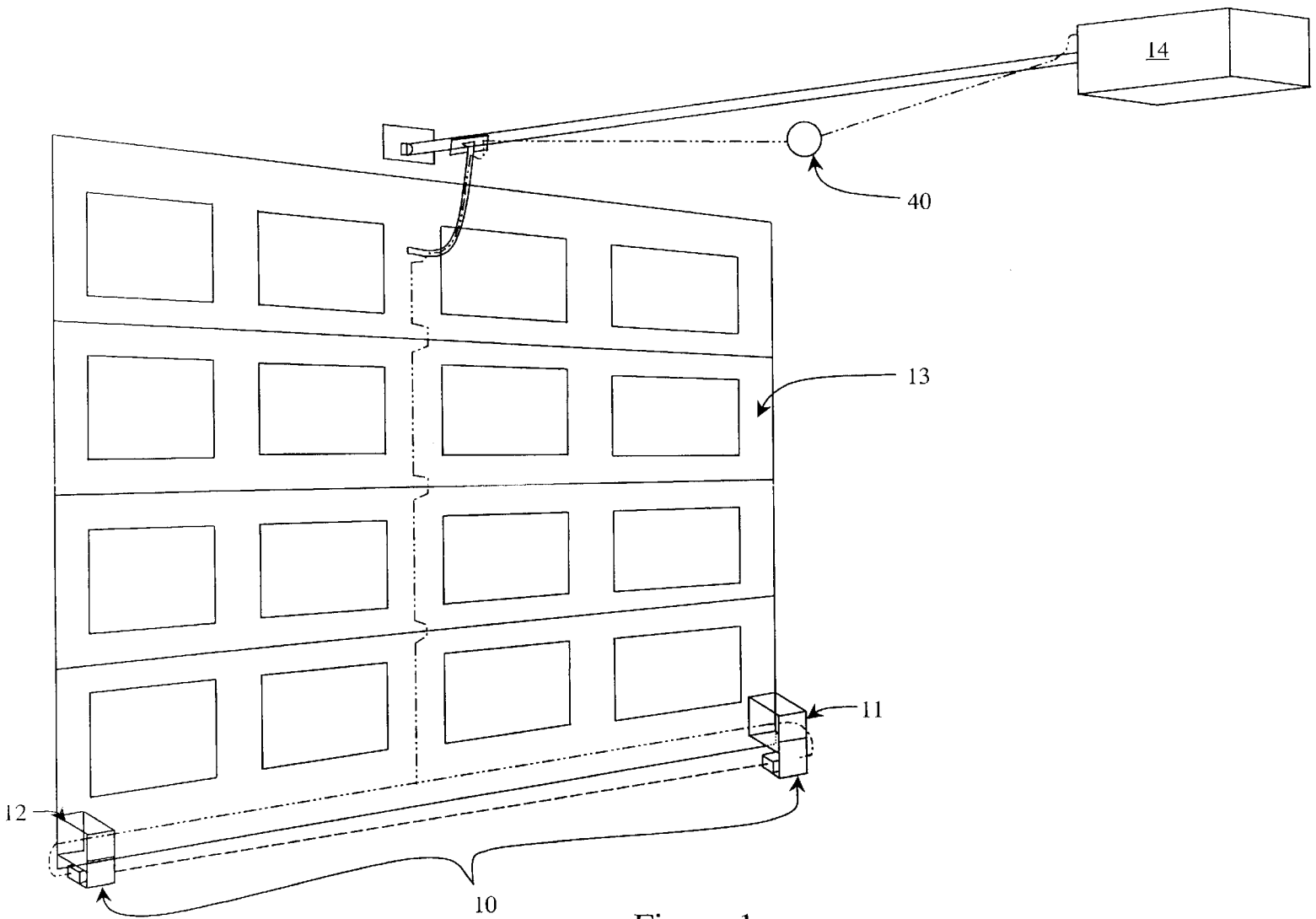
FIG. 1 is an environmental view of the object sensor system of the invention mounted on a garage door equipped with an electric motor door opener.
Figure 3:
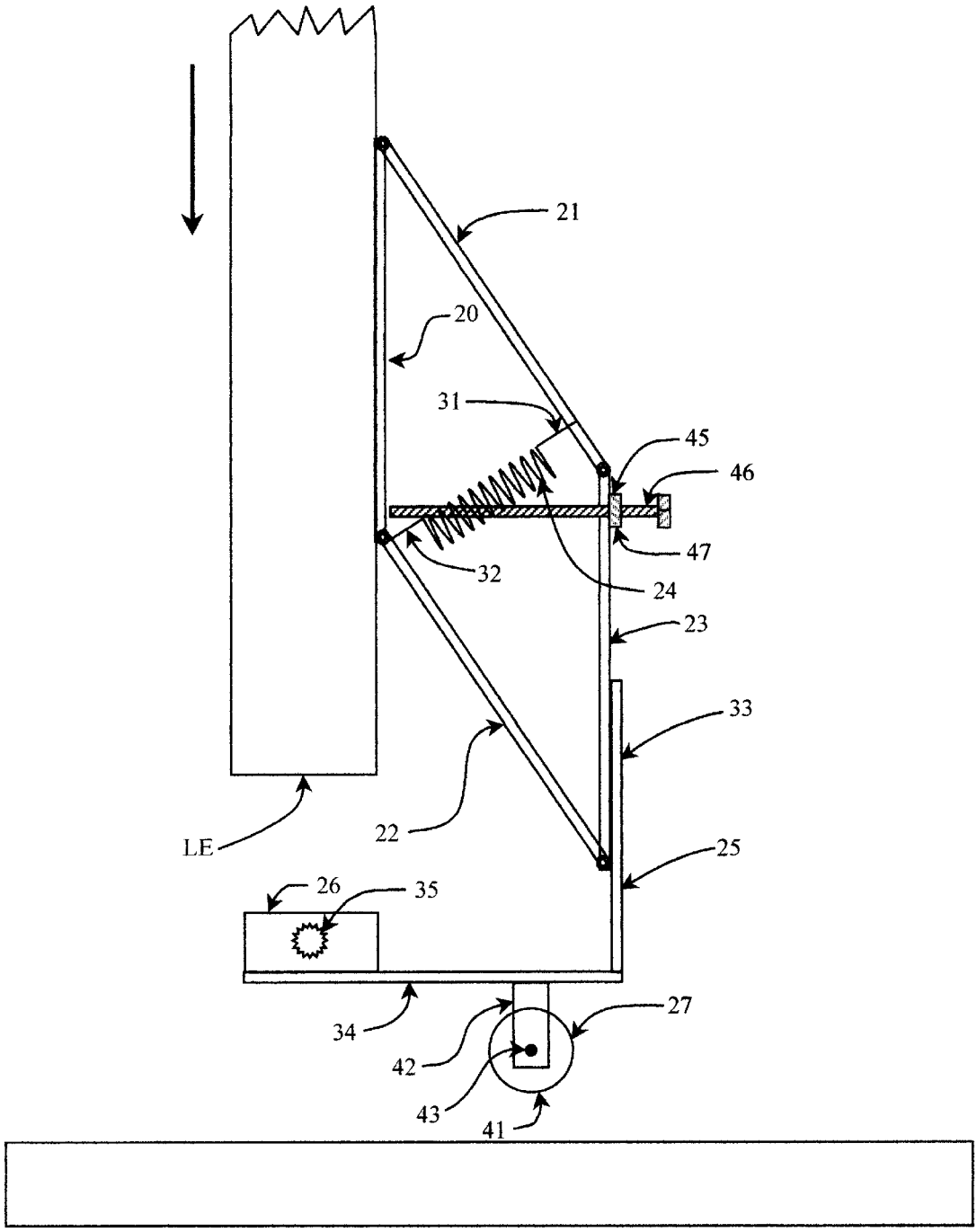
FIG. 3 is a side view of the object sensor of FIG. 2 mounted on a garage door which is shown in an intermediate position approaching a closed position.
Figure 4:
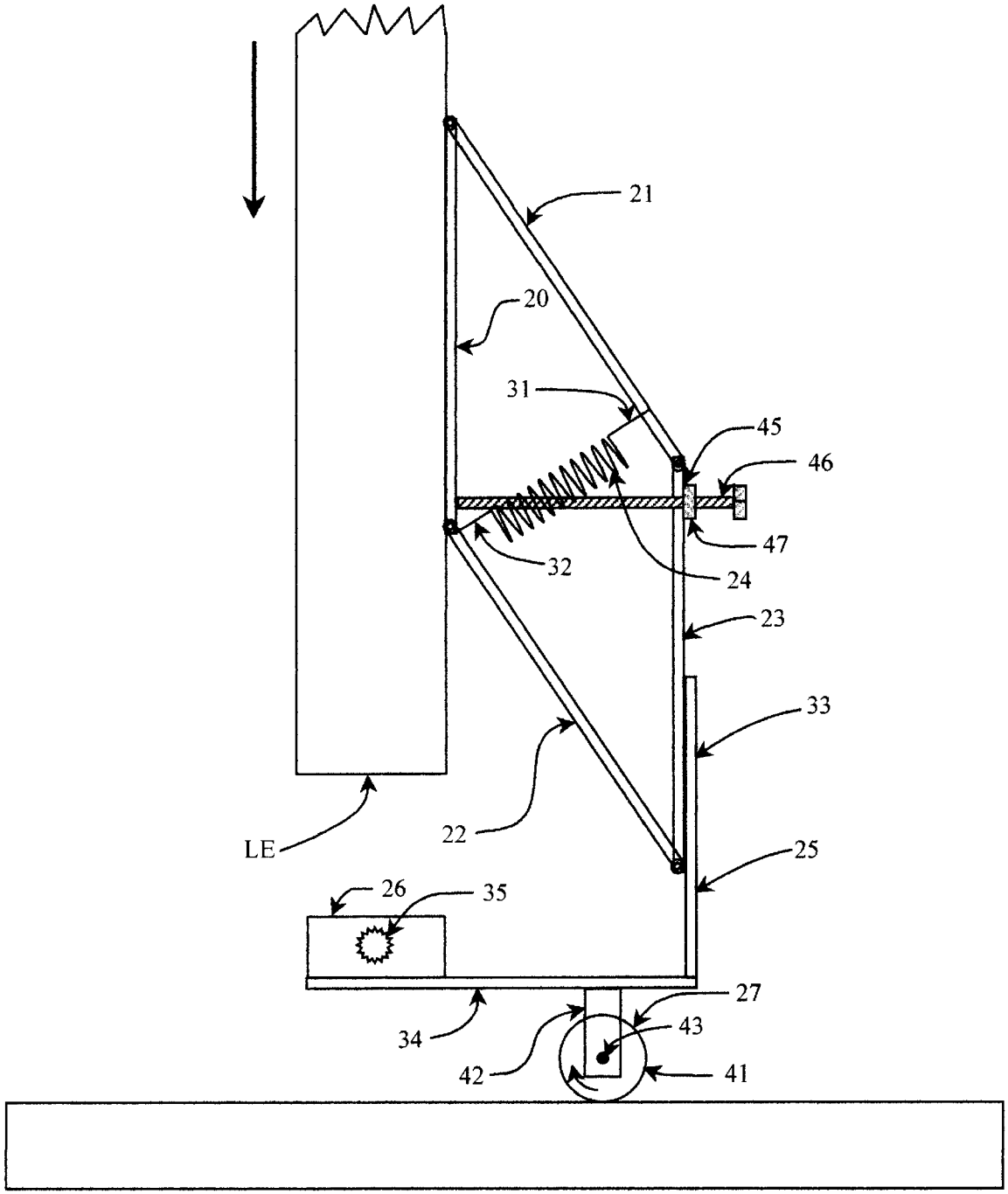
FIG. 4 is a side view of the object sensor of FIG. 2 mounted on a garage door whose leading edge is about to contact ground surface.
Figure 5:
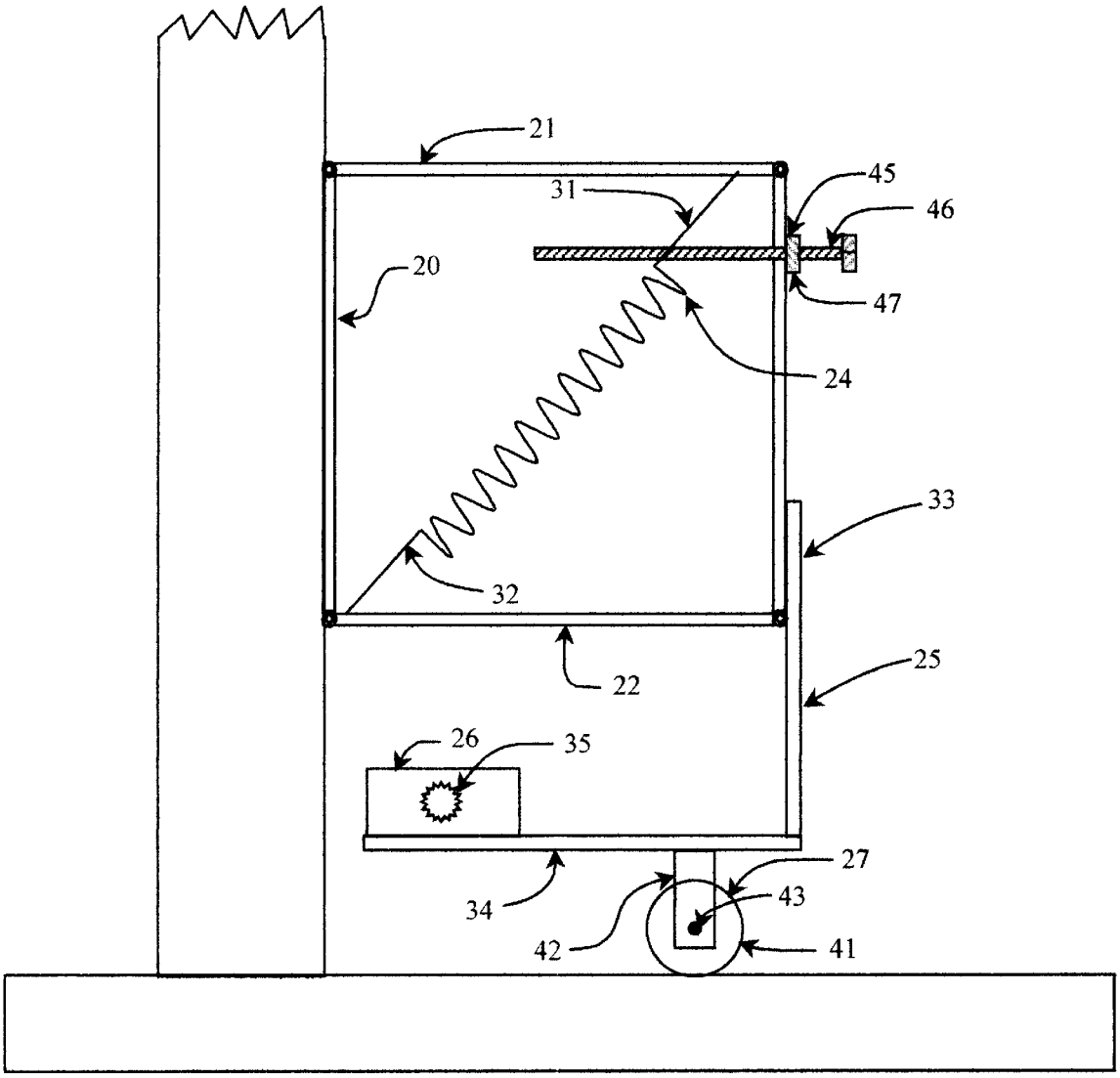
FIG. 5 is a side view of the object sensor of FIG. 2 mounted on a garage door whose leading edge has contacted ground surface and is in a fully closed position

With reference to FIG. 1, there is shown the object sensor system 10 of the invention. The system comprises a first object sensor 11 having an electronic infrared transmitter and a second object sensor 12 having an electronic infrared receiver. The object sensors are mounted on a residential overhead garage door 13. An electric reversible motor 14 is permanently mounted to a ceiling of the garage door and is operatively connected to the garage door 13 to move the door from a fully closed position as shown in FIGS. 1 and 5, to intermediate positions as shown in FIGS. 3 and 4 and to a fully open position (not shown). A leading edge of the door is designated LE and is used to refer to the bottom edge of the door stretching fully across the door. Guide rails for the garage door and a drive chain mechanism for the reversible motor are not shown for clarity purposes. Such components are conventional in nature and are not a part of this invention.

The object sensor 11 is described in detail below. It should be understood that the object sensor 12 has the same components other than the substitution of an infrared receiver for an infrared transmitter.

Figure 2:
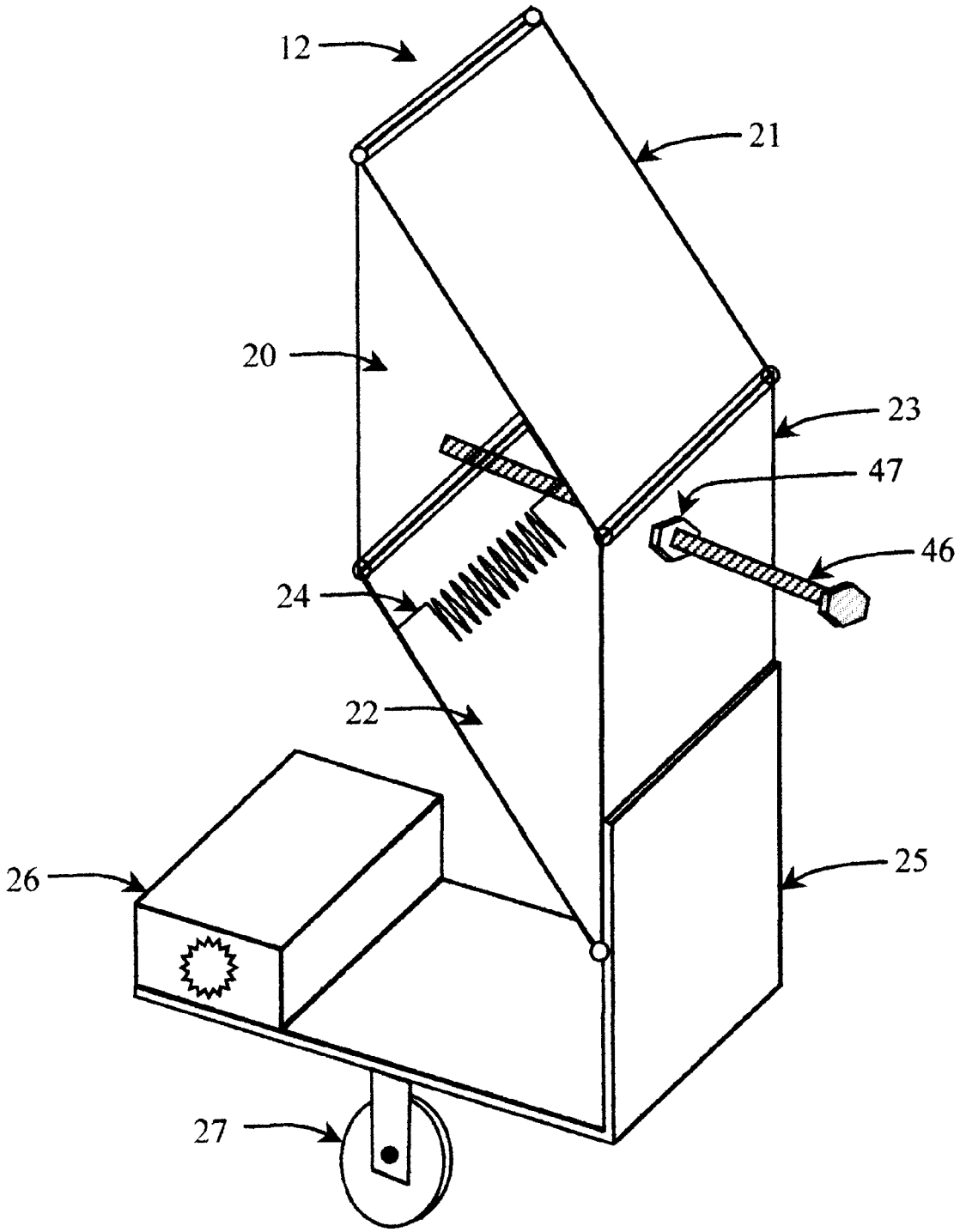
FIG. 2 is a perspective view of one of the object sensors of FIG. 1.

As best seen in FIGS. 2 and 3, the object sensor 11 comprises a mounting plate 20, an upper hinge plate 21, a lower hinge plate 22, a connecting hinge plate 23, a return spring 24, a bracket 25, an electronic sensor 26 and an anti-friction means 27. As will become apparent from the detailed discussion of the individual components in the following paragraphs, the upper hinge plate 21, lower hinge plate 22 and connecting hinge plate 23 all move in concert. The hinge plates 21–23 and bracket 25 are dimensioned so that the electronic sensor 26 is directly below the leading edge of the garage door when the door is at least partially open as seen in FIGS. 3 and 4 and forced backwardly from the door when the door is fully closed as seen in FIG. 5.

With reference to FIGS. 1 and 3–5, the object sensor 11 is permanently mounted on the garage door 13 in the lower right inside corner of the door. It is mounted so that when the door is in the at least partially open position the electronic sensor 26 will be directly below the door's leading edge. The precise placement of the object sensor's mounting plate 20 on the door will depend on the lengths of hinge plates and length of the vertical leg of the bracket. Measurements of the aforesaid components can be taken and the object sensor's placement calculated. Alternatively, the object sensor 11 can simply be approximately positioned on the garage door when partially opened and then adjusted until the electronic sensor 26 is directly below the door's leading edge, preferably about one to about five inches therebelow. The mounting plate 20 is secured to the garage door with conventional attachment means, wood/metal screws being the obvious choice. In like manner, the object sensor 12 is mounted to the lower left inside corner of the garage door.

The mounting plate 20 is typically rectangular-shaped and has a length of from about four inches to about six inches and a width of from about one inch to about four inches. The connecting hinge plate 23 has the same length and preferably the same width.

The upper and lower hinge plates are also generally rectangular-shaped. They have substantially identical lengths, from about four inches to about six inches. Their widths range from about one inch to about four inches. The upper hinge plate is hingeably connected to the upper terminus of the mounting plate. The lower hinge plate is hingeably connected to the lower terminus of the mounting plate. Because of the substantially equal lengths of the mounting plate and the connecting hinge plate and the substantially equal lengths of the upper hinge plate and the lower hinge plate, the three hinge plates move in concert. The mounting plate is always parallel to the connecting hinge plate. Similarly, the upper hinge plate is always parallel to the lower hinge plate.

The manner of hinging the mounting plate and hinge plates together is not important. A living hinge wherein the plates are joined by a flexible material such as a flexible plastic is feasible. Preferably, a joint hinge with interlocking knuckles and a pivot pin is used. Still other hinge mechanisms are usable, it only being necessary that the hinge mechanism allow the upper and lower hinge plates to pivot up to about 90 degrees from the mounting plate and also up to about 90 degrees from the connecting hinge plate.

As evident in FIGS. 2 and 3, the return spring 24 is attached at a first end 31 to the upper hinge plate 21 and at a second end 32 to the lower hinge plate 22. The attachments are made near the same side lateral edges. Preferably, for maximum force, the first end 31 of the spring is attached to the upper hinge plate near the connecting hinge plate's upper hinge axis and the second end is attached to the lower hinge plate 22 near the mounting plate's lower hinge axis. As apparent in FIG. 5, when the garage door is fully closed, the upper and lower hinge plates are substantially parallel to ground surface and the return spring 24 is extended. As the door opens, the return spring 24 urges the upper and lower hinge plates to move together. A downward force from the weight of the bracket 25 and the electric sensor 26 together with the spring force pull the upper and lower hinge plates generally downwardly. This causes the bracket 25 to move forwardly until the electronic sensor 26 is directly below the door's leading edge, as apparent in FIGS. 3 and 4.

It should be apparent that the return spring 24 can be attached to the connecting hinge plate as well as to the mounting plate. Any set of attachment points on the mounting plate, upper hinge plate, lower hinge plate and connecting hinge plate which results in the exertion of a downward force to cause the bracket 25 with its sensor to move under the garage door's leading edge can be used.

The bracket 25 is a right angle bracket. A first leg 33 is substantially vertical and is permanently secured to the connecting hinge plate 23. A second leg 34 of the bracket is substantially horizontal. Based on the aforementioned preferred lengths of the mounting plate, upper and lower hinge plates and connecting hinge plate, the bracket's first leg 33 is preferably from about five inches to about eight inches in length with about two inches to about four inches of that length extending below the hinge axis of the lower hinge plate 22 and connecting hinge plate 23. The second leg 34 of the bracket is about four inches to about six inches in length.

The electronic sensors 26 mounted on the brackets of object sensors 11 and 12 are commercially available. The electronic sensor 26 on the object sensor 11 is an infrared transmitter 35 while the object sensor 12 has an infrared receiver 36. Each sensor as shown is hard-wired to the reversible motor. For this purpose, a retractable wire coil mechanism 40 is used. The mechanism 40 is free-floating between the reversible motor 14 and the garage door 13. It could as well be secured to the garage ceiling. Wiring from the object sensors 11 and 12 is routed to the center of the door, vertically along the door and then horizontally along the ceiling to the reversible motor. The wire coil mechanism 40 is positioned in the wiring path. In operation, the wiring is uncoiled from the mechanism or wound into the mechanism depending on the direction of door travel. Alternatively, each sensor could as well be battery powered with the capability to send a signal to the reversible motor to open, close or stop. Preferably and as shown, the electronic sensor 26 is mounted on the distal end of the bracket's second leg 34. They can be adjustably mounted to allow some lateral movement along the bracket's second leg 34 to ensure that their working position is directly below the garage door's leading edge.

Operation of the electronic sensors is well known. Basically, the infrared transmitter 35 continuously emits a light beam to the infrared receiver 36. If the light beam is interrupted for any reason, a signal is sent to the reversible motor to immediately stop or reverse direction.

Further and still with respect to FIGS. 2, 3 and 5, the anti-friction means 27 is secured to an underside of the bracket's second leg. The anti-friction means 27 facilitates movement of the bracket during the initial opening of the garage door and the final closing of the garage door. Various anti-friction means can be used. One example is a roller 41 mounted to the bracket's underside by a leg 42 and an axle 43. The roller 41 is free to rotate and rolls along ground surface during the garage door's initial opening and final closing. Preferably, the roller is vertically adjustable to accommodate for any uneven floor surfaces. Another anti-friction means which can be used is a slide pad made of low-friction material such as Teflon attached to the underside of the bracket's second leg 34. Still other anti-friction means can be used.

In a preferred embodiment of the invention, each object sensor also includes an adjusting means 45 to aid in positioning the infrared transmitter and receiver relative to the door's leading edge. As best seen in FIGS. 2 and 3, the connecting hinge plate 23 has a threaded hole and a bolt 46 threaded into the hole so that it makes contact with the mounting plate 20. It could also contact the lower hinge plate with the same effect. Threading the bolt 46 inwardly has the effect of moving the connecting hinge plate 23 and attached bracket 25 with its associated electronic sensor 26 backwardly. Threading the bolt 46 out has the effect of moving the connecting hinge plate 23 and attached bracket 25 with its associated electronic sensor 26 forwardly. Preferably, a lock nut 47 is used on the bolt to retain the bolt's position once the electronic sensor is properly positioned. A thumb screw can be used in place of the bolt.

In use, an object sensor with an infrared transmitter is mounted near the garage door's leading and lateral edges. Another object sensor with an infrared receiver is mounted near the garage door's leading and other lateral edges. The object sensors are positioned and permanently mounted on the door so that the infrared transmitter and infrared receiver each extend directly under the door's leading edge an equal distance. The object sensors are in communication with the reversible motor of the electric garage door opener. When the garage door is fully closed, the infrared transmitter and receiver are forced backwardly from the garage door into the garage. As the door rises, the transmitter and receiver move forwardly until directly under the door's leading edge. When the garage door opener receives a signal to close the garage door, the door descends as long as a light beam across the door's leading edge to the receiver is uninterrupted. If the light beam is interrupted, the motor stops running and the door becomes stationary or reverses. If the light beam is not interrupted, the door continues to travel downwardly. When the anti-friction means on the object sensors hit ground surface, each object sensor's upper and lower hinge plates pivot upwardly to pull the bracket and its associated transmitter or receiver backwardly and out of the travel path of the door's leading edge.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

I claim:

1. An object sensor system for mounting on a garage door having a ground contacting leading edge, said object sensor system comprising a pair of object sensors, each said object sensor comprising:

(a) a mounting plate for permanent attachment to the garage door near the leading edge thereof, said mounting plate having an upper terminus and a lower terminus;

(b) an upper hinge plate hingeably connected to the upper terminus of the mounting plate;

(c) a lower hinge plate hingeably connected to the lower terminus of the mounting plate;

(d) a connecting hinge plate hingedly connected at a first end to the upper hinge plate and hingedly connected at an opposed second end to the lower hinge plate so that the upper hinge plate, lower hinge plate and connecting hinge plate move in concert;

(e) a return spring attached at a first end to one of said plates and attached at a second end to another of said plates to urge said upper and lower hinge plates together;

(f) a bracket having a first vertical leg attached to the connecting hinge plate and a second horizontal leg for extending under the leading edge of the garage door;

(g) an electronic sensor permanently mounted on the horizontal leg of the bracket to transmit or receive a light beam to a matching electronic sensor on the other object sensor of the object sensor system for continuously sensing objects directly in a travel path of the garage door's leading edge and transmitting a signal to a motor driven garage door opener; and (h) an anti-friction means attached to an underside of the horizontal leg of the bracket to allow said bracket to slide along ground surface;

whereby when the garage door is at least partially open, the electronic sensor is directly below the leading edge of the garage door to continuously sense objects in the travel path of the garage door until the garage door approaches ground surface whereupon the bracket moves backwardly away from the garage door thereby causing the upper and lower hinge plates to pivot upwardly until the leading edge of the garage door is at rest on the ground surface.

2. The object sensor system of claim 1 further wherein each object sensor has an adjusting means extending from the connecting hinge plate to the mounting plate to adjust a horizontal extension of the bracket and the electronic sensor.

3. The object sensor system of claim 2 wherein the anti-friction means is a roller mounted so as to freely roll along the ground surface.

4. The object sensor system of claim 3 wherein the roller is adjustably mounted on a leg and said leg is mounted on the bracket.

5. The object sensor system of claim 2 wherein the anti-friction means is a slide pad mounted on an underside of the horizontal leg of the bracket.

6. The object sensor system of claim 2 wherein the adjusting means is a thumb screw.

7. The object sensor system of claim 1 wherein the upper hinge plate and the lower hinge plate are substantially equal in length.

8. The object sensor system of claim 7 wherein the upper hinge plate and the lower hinge plate are each from about four inches to about six inches in length.

9. The object sensor system of claim 8 wherein the horizontal leg of the bracket has a length of from about four inches to about six inches and the electronic sensor is attached at a distal end thereof.

10. The object sensor system of claim 7 wherein the mounting plate and the connecting hinge plate are substantially equal in length.

11. The object sensor system of claim 10 wherein the mounting plate and the connecting hinge plate are each from about four inches to about six inches in length.

12. The object sensor system of claim 1 wherein the electronic sensor has wiring for hard wiring to the motor which controls movement of the garage door.

13. The object sensor system of claim 12 further comprising a retractable wire mechanism for retractably holding the wiring extending from the electronic sensors to the motor.

14. The object sensor system of claim 1 wherein the electronic sensor is battery powered.

15. The object sensor system of claim 1 wherein the return spring is attached at the first end to the upper hinge plate and attached at the second end to the lower hinge plate.

16. An object sensor system for mounting on a garage door having a ground contacting leading edge, said object sensor system comprising a pair of object sensors, each said object sensor comprising:

(a) a mounting plate for permanent attachment to the garage door near the leading edge thereof, said mounting plate having an upper terminus and a lower terminus;

(b) an upper hinge plate hingeably connected to the upper terminus of the mounting plate;

(c) a lower hinge plate substantially equal in length to the upper hinge plate and hingeably connected to the lower terminus of the mounting plate;

(d) a connecting hinge plate substantially equal in length to the mounting plate and hingedly connected at a first end to the upper hinge plate and hingedly connected at an opposed second end to the lower hinge plate so that the upper hinge plate, lower hinge plate and connecting hinge plate move in concert;

(e) a return spring attached at one end to one of said plates and attached at another end to another of said plates to urge said upper and lower hinge plates together;

(f) a right angle bracket having a first leg attached to the connecting hinge plate and a second leg extending horizontally from the first leg towards the mounting plate;

(g) an electronic sensor permanently mounted on the horizontal leg of the bracket to transmit or receive a light beam to a matching electronic sensor on the other object sensor of the object sensor system for continuously sensing objects directly in a travel path of the garage door's leading edge and transmitting a signal to a motor driven garage door opener;

(h) a roller attached to an underside of the horizontal leg of the bracket to freely roll along ground surface to allow said bracket to slide therealong; and (i) an adjusting means extending from the connecting hinge plate to the mounting plate to adjust a position of the electronic sensor;

whereby when the garage door is at least partially open, the upper and lower hinge plates extend at a downward angle from the garage door and the electronic sensor is directly below the leading edge of the garage door to continuously sense objects in the travel path of the garage door until the garage door approaches ground surface whereupon the bracket moves backwardly away from the garage door thereby causing the upper and lower hinge plates to pivot upwardly until the leading edge of the garage door is at rest on the ground surface.

17. The object sensor system of claim 16 wherein the upper hinge plate and the lower hinge plate are each from about four inches to about six inches in length.

18. The object sensor system of claim 17 wherein the mounting plate and the connecting hinge plate are each from about four inches to about six inches in length.

19. The electronic sensor system of claim 18 wherein the horizontal leg of the bracket has a length of from about four inches to about six inches and the object sensor is attached at a distal end thereof.

20. The object sensor system of claim 16 wherein the adjusting means is a bolt threaded through the connecting hinge plate to contact the mounting plate.

* * * * *